US006010025A

United States Patent [19]

Bertani et al.

[11] Patent Number: 6,010,025

[45] Date of Patent: Jan. 4, 2000

[54] LID FOR CONTAINERS SUCH AS TINS AND THE LIKE, HAVING A DOUBLE LINE OF WEAKNESS

[75] Inventors: Claudio Bertani; Pietro Cristofori, both of Montecchio Emilia, Italy

[73] Assignee: Pack-Tec International S.r.l., Reggio Emilia, Italy

[21] Appl. No.: 09/180,449

[22] PCT Filed: May 9, 1997

[86] PCT No.: PCT/EP97/02352

§ 371 Date: Nov. 9, 1998

§ 102(e) Date: Nov. 9, 1998

[87] PCT Pub. No.: WO97/43185

PCT Pub. Date: Nov. 20, 1997

[30] Foreign Application Priority Data

May 10, 1996 [IT] Italy ..... MI96A0952

[51] Int. Cl.[7] ..... B65D 17/40

[52] U.S. Cl. ..... 220/276; 220/277; 220/284

[58] Field of Search ..... 220/276, 277, 220/284

[56] References Cited

U.S. PATENT DOCUMENTS

| | | | |
|---|---|---|---|
| 2,344,894 | 3/1944 | Ottesen | 220/284 |
| 2,601,937 | 7/1952 | Ottesen | 220/276 |
| 3,362,570 | 1/1968 | Geiger | 220/284 |
| 4,003,495 | 1/1977 | Grise et al. | 220/268 |
| 5,048,713 | 9/1991 | Tiveron | 220/277 |
| 5,207,346 | 5/1993 | Tiveron | 220/277 |

FOREIGN PATENT DOCUMENTS

| | | |
|---|---|---|
| 0 094 359 | 11/1983 | European Pat. Off. . |
| 0 553 514 | 8/1993 | European Pat. Off. . |
| 2 574 761 | 6/1986 | France . |
| 1228227 RE 93 U | 6/1991 | Italy . |
| 000045 | 6/1993 | Italy . |
| 1 590 580 | 6/1981 | United Kingdom . |

*Primary Examiner*—Stephen K. Cronin

*Attorney, Agent, or Firm*—Finnegan, Henderson, Farabow, Garrett & Dunner, L.L.P.

[57] ABSTRACT

The invention relates to a lid for tins, cans and the like, which lid is made of a layer of sheet metal or plastic that is attached to the wall (3) of the container by means of a seam-folded or other type of joint. The lid has a groove (5) in which the tip of a spoon or other suitable utensil can be inserted so that the latter can act as a lever therein and open the lid by tearing the material along a first line of weakness (6) located on the bottom of the groove (5). The lid advantageously has a second line of weakness (7) that is located in the area where the cross section of the groove (5), which is essentially U-shaped, joins the central portion of the lid; this second line of weakness contributes to weakening the lid material locally, in the above mentioned area, thereby enhancing the leverage exerted in order to open the lid.

6 Claims, 3 Drawing Sheets

LID FOR CONTAINERS SUCH AS TINS AND THE LIKE, HAVING A DOUBLE LINE OF WEAKNESS

DESCRIPTION

The invention relates to a lid for containers such as tins, cans and the like, of the type in which the edge is attached to the wall of the container, comprising at least one groove with an essentially U-shaped cross-section, the bottom of which has a line of weakness, the said groove being designed such that the tip of a spoon or other utensil can engage therein and act as a lever in order to open the lid once it has torn along the line of weakness.

The abovementioned lids are well known and are widely used to close containers intended in particular is for packaging foodstuffs. The specific configuration of these lids enables them to be opened quickly and efficiently without having to use special tin-openers since, because of the line of weakness in the bottom of the groove, an ordinary spoon is all that is needed to achieve the desired objective.

For further information, it should be pointed out that lids of the type considered here already form the subject of Italian patent no. 1,228,227 (application no. 19075-A/89 dated Dec. 1, 1989) and of utility model application no. RE93U000045. Within the context of the continuous search for improvements in the production of these lids, it should be pointed out that it is desirable to reduce the amount of material—which is usually sheet metal but could also be plastic—needed to produce them to a minimum. It should be remembered that containers such as tins or cans to which the above lids are attached are produced in extremely high quantities, of the order of millions of articles, and even the smallest saving in the material used for each lid would, given the enormous number of articles involved, result in considerable economic benefits for manufacturers.

It is worth pointing out at this stage, however, that it is not possible to reduce the thickness of the material from which the lid is made below a certain limit, since there are specific standards governing the matter which state that lids must be strong enough to withstand any knocks that the containers may be subjected to during transportation, as well as any gas pressures which may be generated inside the containers by the products packaged therein. Whilst on the subject of strength, it should also be pointed out that, for the same reasons as those given above, the line of weakness must also have a certain strength which cannot fall below a given safety limit.

As a result of the limits which apply to reducing the layer of material constituting the lid, and in an attempt to reduce costs, there is a current tendency to modify the dimensions—depth and width—of the groove in the lid. In this case too, however, these dimensions cannot be reduced below a certain value since the groove must still allow the tip of a utensil, such as a spoon, knife or the like, to be inserted and act as a lever therein in order to tear the sheet metal along the line of weakness.

The object that the present invention aims to achieve is, therefore, to provide a lid for containers such as tins, cans and the like, that has structural and functional characteristics which, compared with lids of the prior are, enable savings to be made in the quantity of material needed to produce the said lid, but at the same time do not essentially affect its functional properties and its strength, for the same thickness of material used.

This object is achieved with a lid which is defined in the claims below.

In order to give a better understanding of the additional characteristics of the invention and of the advantages that derive therefrom, a description thereof is given below with reference to a preferred and non-limiting embodiment, illustrated in the appended drawings, in which.

Figure 1:
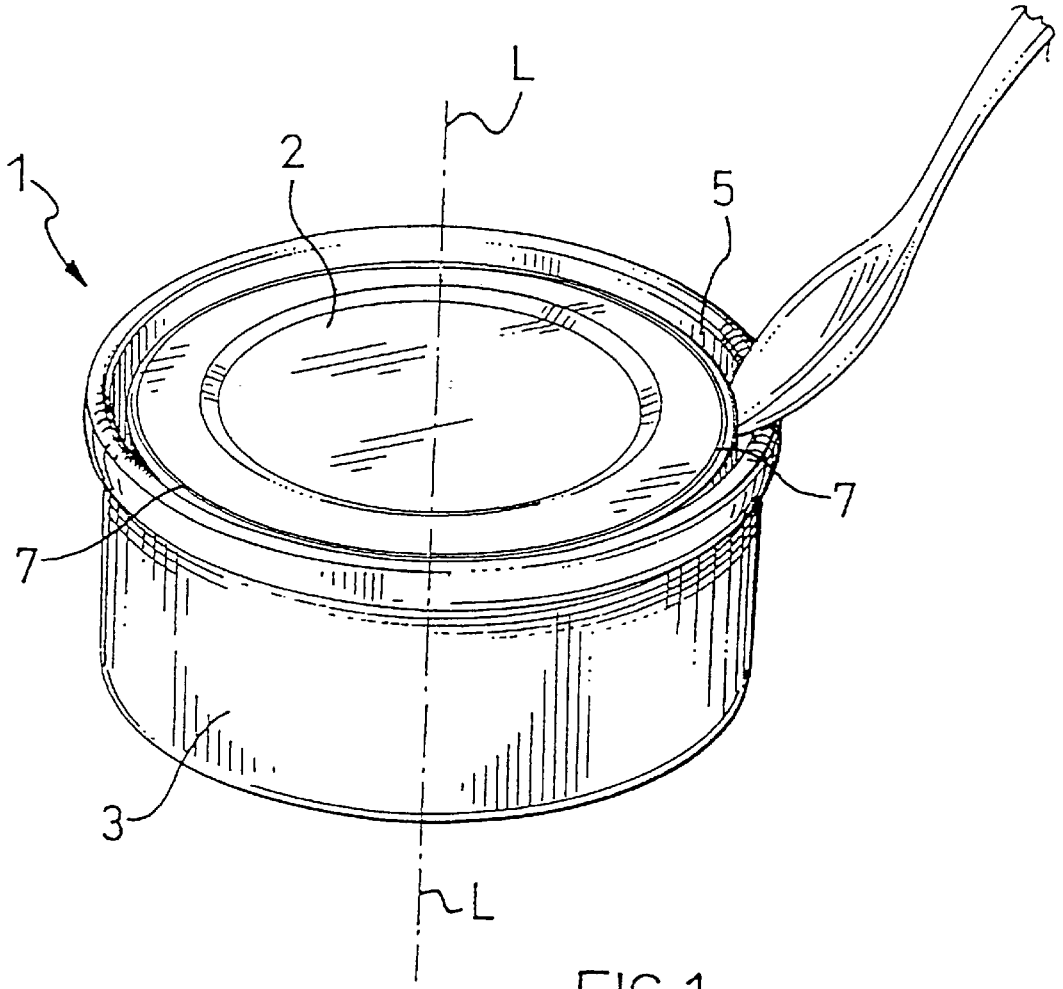
FIG. 1 shows a perspective view of a container to which the lid according to the invention is attached.

With reference to the drawings listed above, the reference numeral 1 denotes, overall, a container with cylindrical geometry about an axis L, to which a lid 2 according to the invention is attached; more specifically, the latter consists of a sheet or disc of sheet metal, in which the edge is seam-folded on to the side wall 3 of the container and which has a groove 5 extending peripherally right around the abovementioned side wall 3, close to the seam-folded edge. This groove is designed so that the tip of a spoon or other utensil can be inserted into it in order to open the container, in accordance with known teachings of the prior art. The groove runs around the circumference of the lid but it could also extend over a generic open line, for example a simple curved segment. The groove 5 also has an essentially U-shaped section consisting of a bottom 5*a*, an internal side 5*b* and an external side 5*c*; the bottom 5*a* has a first line of weakness 6 along which the sheet metal of the lid is designed to tear when the container is opened. In this case, too, the line of weakness 6, which runs circumferentially right around the groove 5, could alternatively follow any open line, partly depending on the shape of the groove 5.

In addition, there is a second line of weakness 7, of the same type as the first, in the area where the U-shaped section of the groove joins that part of the lid 2 located towards the axis L of the container. This second line of weakness also runs around a circumference of the lid, but could follow any generic open line.

Figures 2, 3:
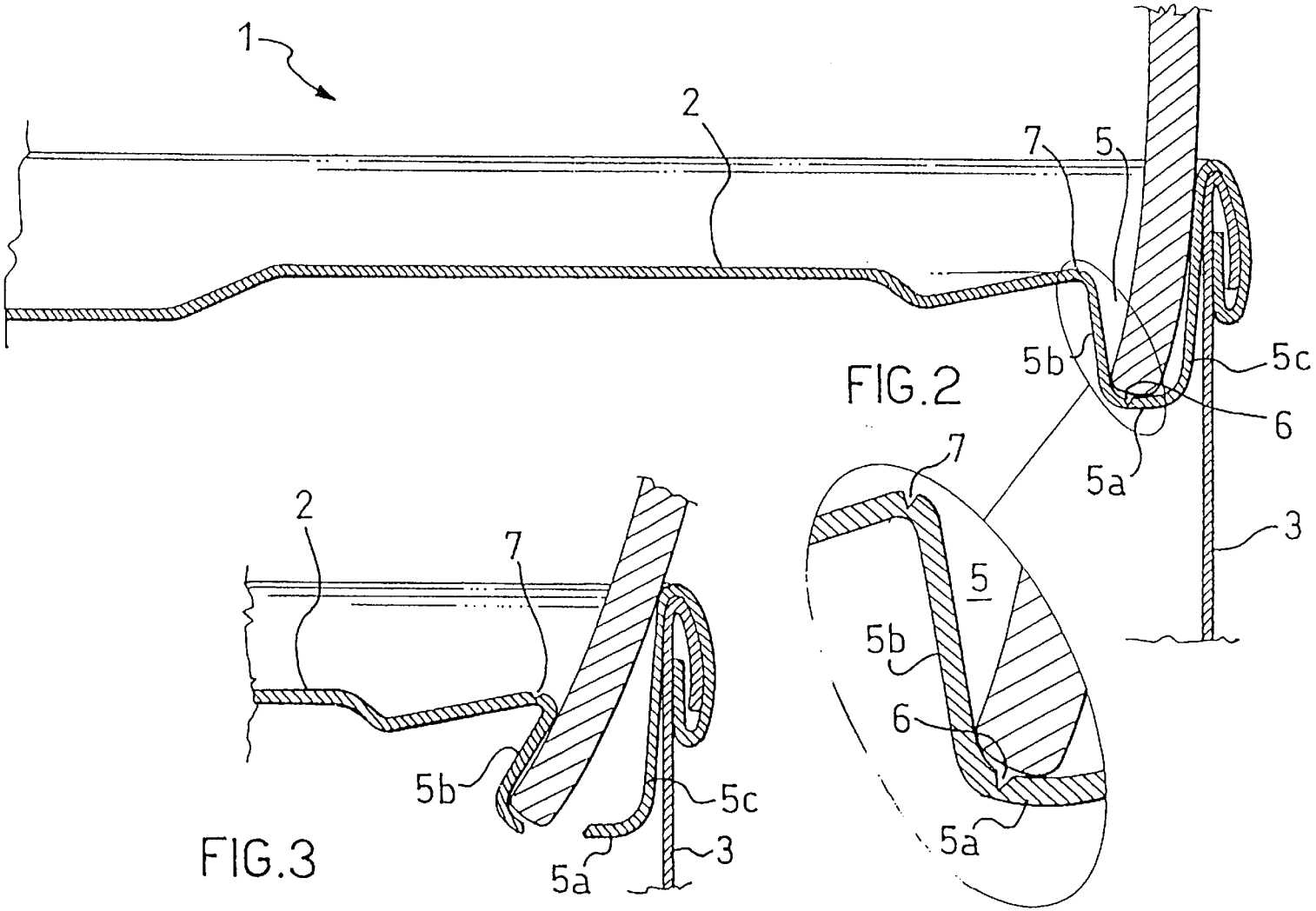
FIGS. 2 and 3 show a cross-section, on a radial plane of the container in FIG. 1, of the lid according to the invention at different stages of operation.

In order to open the lid described above, the tip of a spoon or other utensil is inserted into the groove 5; by using the external side 5*c* and/or the edge of the lid 2 which has been seam-folded on to the wall 3 as a fulcrum, the sheet metal forming the lid tears along the first line of weakness 6 and then, once it has torn along this line, the sheet metal bends along the second line of weakness 7, as may be seen in FIG. 3. Therefore, although the way in which the lid according to the invention is opened is partly analogous to that used to open lids of the already known type, discussed at the beginning of this description, the advantages offered by this invention as a result of the presence of the second line of weakness are worth emphasizing.

This is because the leverage exerted by the tip of the spoon or other utensil works more efficiently as a result of this second line. In practice, as may also be deduced by examining FIGS. 2 and 3, the local rigidity of the sheet metal in the area where the Ushaped groove joins the lid, together with the elastic reaction of the internal side 5*b* in response to the leverage exerted by the spoon tip, are reduced as a result of the second line of weakness and, consequently, this makes the lid easier to open.

The abovementioned decrease in the local rigidity of the sheet metal makes it possible to reduce the depth of the groove 5 without adversely affecting the functional characteristics of the lid or the way in which it is opened; indeed, reducing this depth also reduces the extent to which the tip of the spoon or other utensil can be inserted into the groove and, consequently, the moment resulting from the force applied by the abovementioned tip on the internal side 5*b* relative to the area where the U-shaped section joins the rest of the lid is also reduced since this force is applied at a point closer to the said area. Although this feature would not in itself increase the ease with which the lid is opened as a result of the material tearing along the first line of weakness 6, it is compensated for by the second line of weakness 7 which, as has already been stated, reduces the rigidity of the sheet metal, and therefore its elastic reaction, in the area where the groove joins the lid.

In circumstances such as these it is therefore possible to reduce the depth of the groove, and thus bring about a saving in the material used to make the lid, without adversely affecting its functional characteristics, given that, compared with a lid made in the conventional way and with sheet metal of the same thickness, and of course for the same width of groove, the overall extension of the U-shaped section is reduced.

From this line of reasoning it is, therefore, possible to see how the invention achieves the object it has set itself and which was referred to above; it is quite clear how, as a result of the second line of weakness 7 and its specific function, it is now possible to reduce the material needed to make a lid according to the invention with respect to a conventional lid having the same sheet metal thickness and the same groove width.

Figure 4:
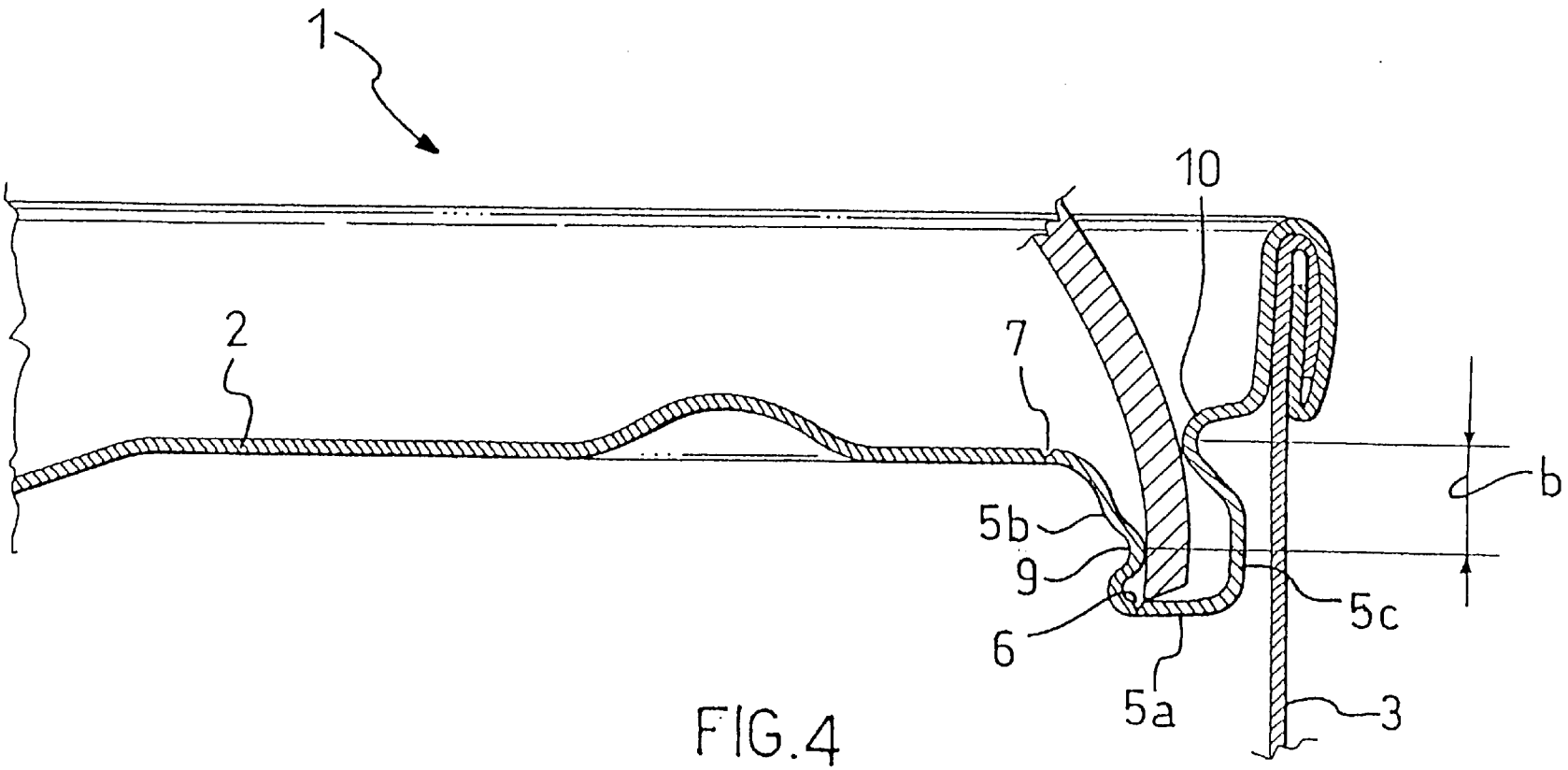
FIG. 4 shows a variant of the lid illustrated in the preceding figures.

Naturally, variants of the invention with respect to the example just described are possible. One such variant is illustrated in FIG. 4 in which elements that are equivalent in terms of structure or function to those described previously have been given the same reference numeral.

In this variant of the invention, a first and a second rib 9 and 10 are present on the internal side 5*b* of the U-shaped cross-section of the groove 5 and on the external side 5*c* of the latter respectively. The purpose of these ribs is to further enhance the leverage exerted by the tip of a spoon or other utensil used to open the lid. As can indeed be seen in FIG. 4, the second rib 10 represents both a raised support point for the outside of the bowl of the spoon, and the fulcrum of the lever constituted by the latter, whilst the first rib 9 is located at the point where the force exerted during opening is applied by the tip of the spoon against the internal side 5*b* and, according to the law of action and reaction, the point where the internal side exerts a force against the spoon. It should be noted that, all other conditions in the example illustrated previously in FIGS. 2 and 3 being equal, that is to say the sheet metal thickness, the utensil used to open the lid and the width of the U-shaped section of the groove being the same, the presence of the two ribs 9 and 10 reduces the distance between the fulcrum of the lever and the point at which the force is applied to the internal side 5*b*, making the lid easier to open by virtue of the fact that the arm b of the lever defined by the distance between these ribs is reduced.

It is worth pointing out, however, that the advantage in applying this variant of the invention derives from the presence of the second line of weakness 7 since, if it is true that the leverage is enhanced by reducing the arm b, it is also true that the point at which the force exerted by the tip of the spoon or other utensil is applied is, in this variant, constituted by the rib 9 and is located much closer to the area in which the U-shaped section of the groove 5 joins the rest of the lid. The latter feature, as has already been stated, would not in itself be in any way advantageous in opening the lid, given that the shorter the distance between the point at which the force is applied on the internal side 5*b* and the abovementioned joining area, the smaller the moment resulting from this force with respect to the said joining area, where the sheet metal bends as the lid is opened. The presence of the second line of weakness, therefore, compensates for any disadvantages which may result from reducing this distance as a result of the presence of the two ribs in this variant.

Of course the dimensions, shape and distance between the ribs 9 and 10 which characterize this variant could differ from those illustrated, as long as they do not adversely affect the functional features and the advantages which derive from this variant.

It is also worth bearing in mind that, although sheet metal has been referred to in the embodiments of the invention described above as the material used to make the lid, this does not exclude plastic being used in its place; needless to say, therefore, in such circumstances it might be necessary to carry out certain modifications to the container, especially with regard to the attachment of the lid 2 to the wall 3, which attachment, in place of the folded seam, could consist of another type of joint which would, of course, be capable of achieving the same result.

Lastly, it is scarcely necessary to point out that, even though in the examples described the lid illustrated is, apart from some stiffening corrugations, essentially flat, it is not thereby excluded that the principles of the invention could also apply to lids of a different shape, maybe concave or convex lids, in the form of a spherical cap or some other shape.

These and other possible variants which may be made to the invention, even though they are not explicitly discussed in this document, should nevertheless be considered to fall within the scope of the teaching provided by the invention, insofar as this teaching may be deduced from the description given above and from the claims given below.

We claim:

1. Lid for containers in general such as tins, cans and the like, of the type in which the edge is attached to the wall (3) of the container, comprising at least one groove (5) with an essentially U-shaped cross-section, the bottom (5*a*) of which has a line of weakness (6), the said groove (5) being designed such that the tip of a spoon or other utensil can engage therein and act as a lever in order to open the lid (2) once it has torn along the line of weakness (6), characterized in that it comprises a second line of weakness (7) extending within the area where the U-shaped cross-section of the groove (5) joins the rest of the lid.

2. Lid according to claim 1, in which the lid (2) is made of sheet metal.

3. Lid according to claim 1, in which the lid (2) is made of plastic.

4. Lid according to any one of claims 1, 2 or 3, characterized in that it comprises a first and a second rib (9, 10) located on an internal side (5*b*) and on an external side (5*c*) of the cross-section of the groove (5) respectively, the second rib (10) being at a higher level than the first rib (9) with respect to the line of weakness (6) on the bottom (5*a*) of the U-shaped section of the groove (5) and being designed such that it constitutes a support for the tip of a spoon or other utensil to act as a lever against the abovementioned first rib.

5. Lid according to claims 1, 2 or 3, wherein the groove runs around the circumference of the lid, along the edge of the lid that is attached to the wall (3) of the container.

6. Lid according to claim 4, wherein the groove runs around the circumference of the lid, along the edge of the lid that is attached to the wall (3) of the container.

* * * * *